US008627695B2

(12) United States Patent
Viguera Sancho

(10) Patent No.: US 8,627,695 B2
(45) Date of Patent: Jan. 14, 2014

(54) METHOD FOR ULTRASOUND SHOT-BLASTING OF TURBOMACHINE PARTS

(75) Inventor: Ana Viguera Sancho, Alfortville (FR)

(73) Assignee: SNECMA, Paris (FR)

( * ) Notice: Subject to any disclaimer, the term of this patent is extended or adjusted under 35 U.S.C. 154(b) by 303 days.

(21) Appl. No.: 12/988,436

(22) PCT Filed: Apr. 17, 2009

(86) PCT No.: PCT/EP2009/054595
§ 371 (c)(1),
(2), (4) Date: Oct. 18, 2010

(87) PCT Pub. No.: WO2009/127725
PCT Pub. Date: Oct. 22, 2009

(65) Prior Publication Data

US 2011/0030434 A1 Feb. 10, 2011

(30) Foreign Application Priority Data

Apr. 18, 2008 (FR) ..... 08 02178

(51) Int. Cl.
*C21D 7/06* (2006.01)

(52) U.S. Cl.
USPC ..... 72/53; 29/90.7; 451/38; 451/39

(58) Field of Classification Search
USPC ..... 72/53, 430, 707; 29/90.7, 889.7
See application file for complete search history.

(56) References Cited

U.S. PATENT DOCUMENTS

| | | | | |
|---|---|---|---|---|
| 6,490,899 | B2 * | 12/2002 | Berthelet et al. | 72/53 |
| 6,536,109 | B2 * | 3/2003 | Berthelet et al. | 29/889.1 |
| 7,481,088 | B2 * | 1/2009 | Bayer et al. | 72/53 |
| 7,644,599 | B2 * | 1/2010 | Hoffmann-Ivy et al. | 72/53 |
| 7,647,801 | B2 * | 1/2010 | Cheppe et al. | 72/53 |
| 7,992,416 | B2 * | 8/2011 | Stonitsch et al. | 72/53 |
| 2006/0174483 | A1 | 8/2006 | Bayer et al. | |
| 2009/0044406 | A1 * | 2/2009 | Dautl et al. | 29/889.7 |
| 2009/0095042 | A1 | 4/2009 | Hoffmann-Ivy et al. | |

FOREIGN PATENT DOCUMENTS

| | | |
|---|---|---|
| DE | 10 2004 059 592 | 5/2006 |
| EP | 1 623 794 | 2/2006 |
| FR | 2 873 609 | 2/2006 |
| SU | 608 564 | 5/1978 |
| WO | 2007 056978 | 5/2007 |

OTHER PUBLICATIONS

International Search Report issued Jul. 21, 2009 in PCT/EP09/54595 filed Apr. 17, 2009.

* cited by examiner

*Primary Examiner* — Dana Ross
*Assistant Examiner* — Homer Boyer
(74) *Attorney, Agent, or Firm* — Oblon, Spivak, McClelland, Maier & Neustadt, L.L.P.

(57) ABSTRACT

A method for ultrasound shot-blasting by a cloud of balls set in motion through contact with a sonotrode having one metallic surface including an area of difficult access, characterized in that the surface is that of a hook axially restrained on a turbomachine blade including a groove provided between the hook and the base of the blade, and the cloud of balls is contained in a chamber encompassing the groove and the surface portion outside the groove.

11 Claims, 3 Drawing Sheets

METHOD FOR ULTRASOUND SHOT-BLASTING OF TURBOMACHINE PARTS

BACKGROUND OF THE INVENTION

1. Field of the Invention

The present invention relates to a method for treating and compressing surfaces having areas difficult to access, more specifically the axial retaining hooks of turbomachine blades including a groove between the hook and the foot of the blade.

2. Description of the Related Art

In a gas turbine aeronautical engine, the axial retaining hooks of the blades in the housing of said blades on a turbine disk and the rims of the turbine disks including a radial groove axially retaining the blades are strongly stressed. The blade hooks undergo a high level of static stresses, with regard to the grooves of the disks, so there are contact and wear problems between the disk and the flange applied against the face of the disk.

Currently, to improve their mechanical performance, these parts are surface treated, by conventional shot-blasting, in order to enhance their fatigue and corrosion resistance.

The prestressing shot-blasting operation is a mechanical treatment intended to improve the properties of a metal part by surface hardening. It is based on the structural transformation of the materials. The conventional method consists in placing the mechanical parts under surface compression, by the projection of small steel, glass or ceramic balls. This shot-peening operation creates a compressed area which is the seat of internal compression stresses through which the resistance is increased.

According to an example of conventional shot-blasting, the surface is hammered by projecting steel balls BA 315 (steel balls with a diameter of 0.315 mm) with an intensity F15A (according to the Almen index). A gaseous flux is used, produced by expansion through a nozzle, then the nozzle is moved, parallel to the surface of the part, or the part is moved relative to the nozzle, to cover the surface to be treated.

Given the difficulty in accessing certain areas, this type of shot-blasting cannot be done in optimal conditions. As it happens, the shot-blasting jet cannot be directed directly onto the surface and the shot-blasting is done by bounce, in the best cases.

Bounce shot-blasting is much less effective because the balls arrive at the surface with a weaker kinetic energy. Also, in some cases, the compression level is not sufficient to treat the surface of the part.

Furthermore, conventional shot-blasting does not give an assurance of a good coverage of the areas difficult to access such as the blade grooves or even the disk grooves.

Nor is the use of the laser shock compression method applicable to these areas. As it happens, since these areas are concealed, they cannot be accessed by the laser beam.

Laser shock treatment is a method that aims to generate plasticizing shock waves in a material, in order to also improve its surface properties. The shock waves are obtained by focusing on the surface of the material a very intense laser impulse (GW/cm2) in the presence of a containment medium over very short periods (a few nanoseconds). The treatment is likely to induce residual compression stresses to thicknesses reaching several hundreds of micrometers, and do so on a wide variety of materials, in particular for the applications that are of interest in the field of steels, aluminum alloys or titanium. The treatment is used to improve the surface properties, such as fatigue, wear or even corrosion resistance. One of the benefits of this technique lies in the fact that the surface conditions of the parts are almost unchanged.

The applicant was set the objective of treating surfaces on a hook axially retaining a turbomachine blade having areas of gas turbine engine parts difficult to access by using the ultrasound shot-blasting method.

The ultrasound shot-blasting method makes it possible to compress and thus harden the surface layers of metal materials, the aim of this technique being to improve the life of the parts. The method consists in causing a sonotrode to vibrate, at frequencies close to the ultrasound frequency, via acoustic elements, linked to a generator. Balls of different kinds are propelled toward the material that has to be shot-blasted, via the sonotrode.

In order to overcome the drawbacks of the conventional surface treatment methods on areas difficult to access, the invention consists in applying the ultrasound shot-blasting method to said areas, of blade groove type, for which the methods such as conventional shot-blasting or laser shock do not allow complete coverage of the surface.

BRIEF SUMMARY OF THE INVENTION

According to the invention, the method for ultrasound shot-blasting, by means of a cloud of balls set in motion on contact with a sonotrode, a metal surface including an area difficult to access is characterized in that, the surface being that of a hook axially retaining a turbomachine blade including a groove provided between the hook and the foot of the blade and a surface portion outside said groove, the cloud of balls is contained in a chamber encompassing said surface.

Advantageously, the application of the method gives the possibility of a deeper compression in the areas difficult to access and, consequently, makes it possible to improve the tolerance to damage (fatigue, fretting, etc.).

The shot-blasting method targets parts made with a material from the group comprising steel, titanium alloy or nickel-based superalloy or aluminums.

The advantage of the application of the method is the possibility of obtaining a complete coverage, and a better surface condition, without any material folds in the corners. Another advantage lies in the fact that this method is highly repetitive.

The invention is of interest when said groove of the hook has a width of between 1.5 mm and 10 mm and a depth of between 1.5 mm and 20 mm.

Use is more particularly made of balls that have the following characteristics:

they have a diameter less than or equal to 2.5 mm and a weight greater than or equal to 0.5 g, and a diameter of between 300 μm and 2.5 mm.

These are steel bearing balls with a low carbon content, and the vibration amplitude of the sonotrode is greater than or equal to 20 μm.

Preferably, the treatment time is between 5 and 200 seconds.

The sonotrode forms a portion of the wall of the chamber.

The patent FR2816538 is known, which describes a method for increasing the life of the blade attachments on a turbine rotor that implements an ultrasound shot-blasting of the grooves and of the blade feet. The shot-blasting is performed with an Almen deflection at least equal to F8A in order to increase the compressive prestressing of the surfaces in contact without increasing roughness. The balls are projected by the percussion of a sonotrode set to vibrate and contained in a chamber formed by the annular or axial groove, the sonotrode being introduced into the mouth of the latter and two ears covering the lateral openings. The accessibility of the areas to be treated is not at issue in the teaching of this patent since the grooves housing the blades make it possible to form chambers with their wall.

The patent FR 2873609 relates to the ultrasound shot-blasting and use of projectiles with which to obtain an adequate treatment intensity on concave surfaces having a smaller radius of curvature than that of the projectiles. The projectiles have a hardness and a density that are both high while being of a small dimension, and their use makes it possible to treat areas that are difficult to access with conventional projectiles having small radii of curvature. These projectiles are capable of acquiring a kinetic energy that is great enough to generate the desired level of stresses in the part. This patent describes a number of embodiments of chambers suited to the configuration of the surfaces to be treated. However, its teaching does not include the treatment of parts that have a part with a groove with a small opening.

BRIEF DESCRIPTION OF THE DRAWINGS

The aims, aspects and advantages of the present invention will be better understood from reading the description given hereinbelow of the various embodiments. These are described as nonlimiting examples. The appended drawings are described below.

DETAILED DESCRIPTION OF THE INVENTION

In a jet engine, the rotor disks have a rim, on the periphery of which are mounted a plurality of removable blades. The blades are mounted in axial grooves, dovetailed for example, machined into the rim, and comprise a foot, also dovetailed, machined at the base of the blade, assembly being achieved by fitting the foot into the groove. The blade feet are fitted into the grooves by sliding, with a limited play. The feet are immobilized axially via axial retaining hooks attached to the feet of the blades. The hooks cooperate with a transversal retaining ring positioned between the foot of the blade and the hook. Thus, the grooves contain the axial movement of the blade feet. A platform (14) topping the foot of the blade, delimits the jet of gas. The material is taken from the group comprising steel, titanium alloy, nickel-based superalloy or aluminums.

Figure 1:
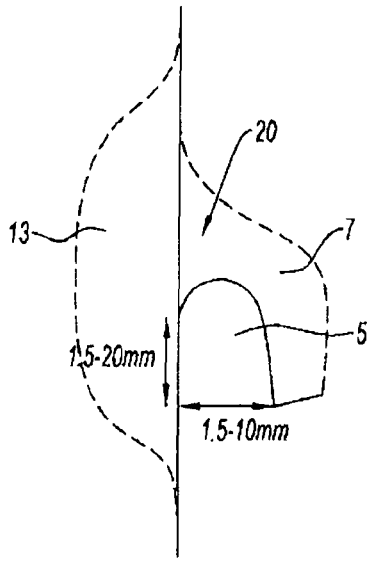
FIG. 1 diagramatically represents a turbomachine blade hook.

FIG. 1 shows the geometry involved in applying the inventive method. The surface to be treated comprises the interior of the groove 5 formed between the hook 20 and the foot 13 of the blade, and the adjacent outer surface portion 7. It consists of an area 5 in the form of an inverted U. The width of this area varies between 1.5 mm and 10 mm, and the depth varies between 1.5 mm and 20 mm. The surface to be treated also includes the surface portion 7 of the hook outside the groove 5.

The hooks are greatly stressed; the high level of static stresses on said hooks may lead to breakage and wear problems.

Figure 4:
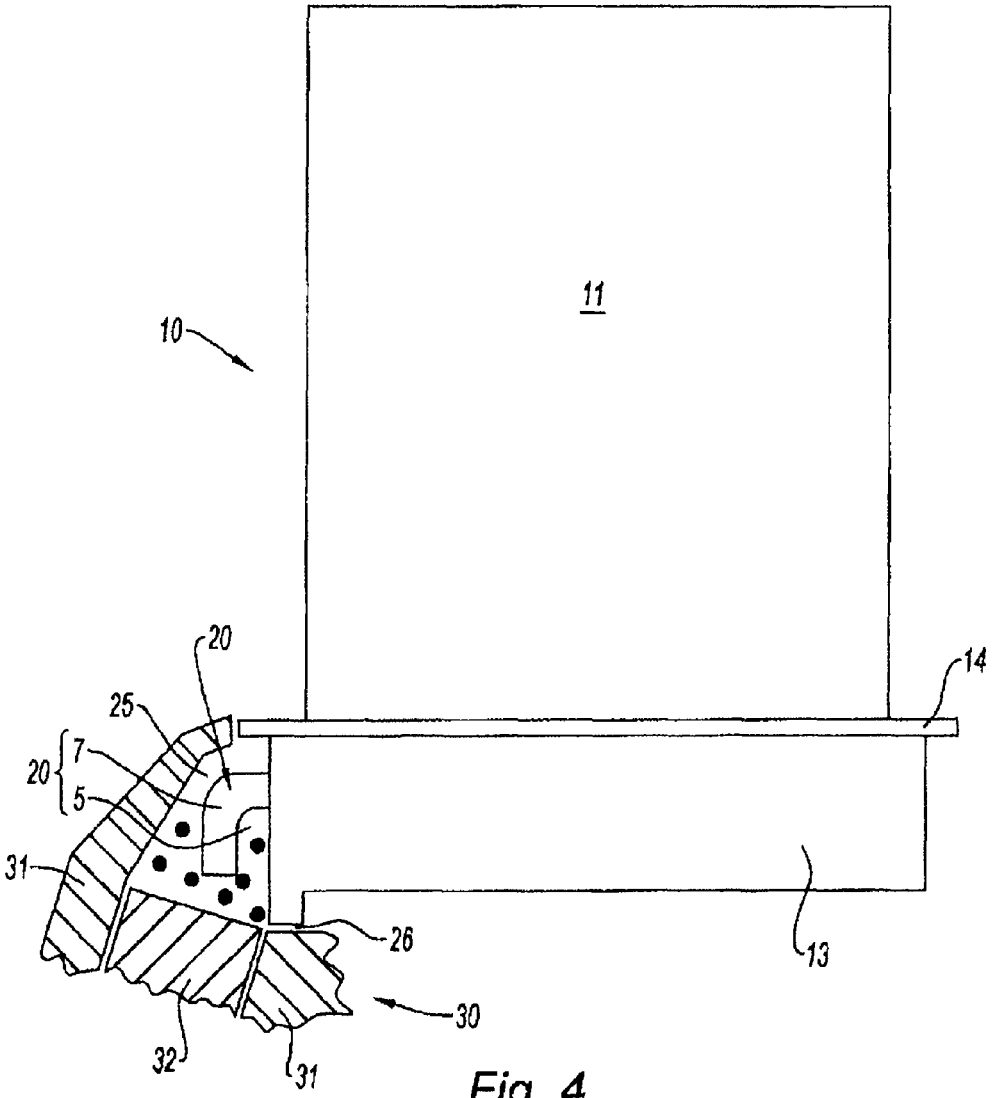
FIG. 4 shows the toolage to allow for the ultrasound shot-blasting of blade hooks.

FIG. 4 shows the toolage developed to enable the hooks to be ultrasound shot-blasted. The blade 10 comprises, schematically a vane 11, a foot 13, with dovetail-configuration section for example, and, possibly, a stilt. A platform (14) is interposed between the foot 13 and the vane 11.

The toolage 30 comprises a support plate with a vibrating surface 32 and a sonotrode, excited by means producing vibrations at an ultrasound frequency, not shown in the drawings. Said vibrating surface constitutes the active wall of a chamber 25. In this volume defined by the walls 31, on one side of the vibrating surface 32 of the chamber, an opening 26 is provided, through which the hook 20 of the blade 10 is introduced. The opening 26 is blocked by the face of the foot of the blade with the hook.

The hook 20 is thus included in the chamber. The groove 5 and the surface portion 7 of the hook, adjacent to and outside the groove, are contained in the chamber. The groove here has a width of 3.2 mm and a depth of 7.26 mm.

The vibrating surface 32 is situated a short distance away from the hook 20. It is wider than the groove 5 and sees at least part of the surface portion of the hook outside the groove 5.

Balls 2, with a diameter of 1.5 mm, are introduced into the chamber 25 through the opening 26. When the vibrating surface 32 is subjected to ultrasound oscillations by the sonotrode, a cloud of balls is created in the chamber 25. The balls are propelled toward the hook 20, striking the wall of said groove 5 and the adjacent surface portion 7.

The frequency of the ultrasound oscillations, the dimensions of the vibrating surface 32, and the diameter, the material and the weight of the balls are chosen such that the area of the groove of the hook but also the surface portion outside the groove is shot-blasted uniformly for a very short time.

In the above example, the parameters retained, after the adjustment of the ultrasound shot-blasting, with the toolage are given in the table below:

| Condition | |
|---|---|
| Type of balls | 100C6Ø1, 50 mm |
| Weight of balls | 2.00 g |
| Amplitude | 120 μm |
| Processing time | 75 seconds |
| Coverage rate | >125% |

One not-inconsiderable advantage of ultrasound shot-blasting is that it can be implemented with only a small quantity of balls. It is therefore possible, in the present case, to use high-quality balls such as steel bearing balls. These balls have a higher hardness than tungsten carbide balls. Steel bearing balls do not break, they are perfectly spherical, and consequently do not produce any sharp edges likely to increase the roughness of the surface of the shot-blasted part.

The shot-blasting time is determined according to the rate of coverage, the rate of coverage being the ratio between the surface impacted and the total surface area exposed to the shot-blasting.

We note that, for a rate of coverage corresponding to 125%, the shot-blasting time is 75 seconds.

The adjustment of the ultrasound shot-blasting was done on a hook 20, over an area with a width of 3.2 mm and a depth of 7.26 mm. The parameters used for the method were as follows: diameter of the balls between 300 μm and 2.5 mm, with a weight of between 0.5 and 5 grams, an amplitude of between 20 and 500 μm, and with a treatment time varying between 5 and 200 seconds.

Figure 2:
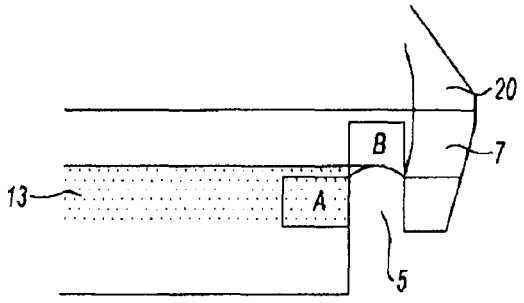
FIG. 2 schematically represents areas of stress analysis by X diffraction.
Figure 3:
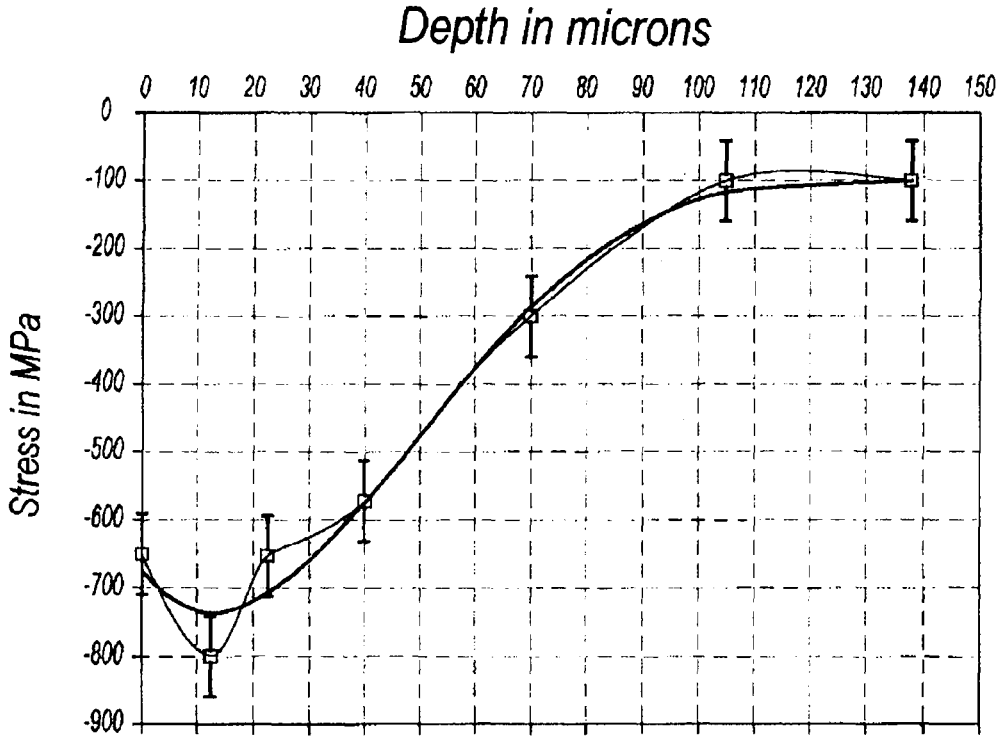
FIG. 3 shows the profile of the stresses obtained by conventional shot-blasting, in the analysis area A of FIG. 2, with, on the x-axis, the depth in microns and, on the y-axis, the residual stress value in MPa.

As can be seen in FIG. 2, stress measurements were taken on the areas A and B of the foot of the blade including the groove. The area A is formed by a volume of the foot 13 delimited by the lateral surface of the groove 5 and the area B is formed by a volume of the foot 13 delimited by the bottom of the groove 5. These measurements were taken to determine the residual stresses depth-wise by X diffraction. The result in terms of stress profile obtained by conventional shot-blasting BA 315 (steel ball with a diameter of 0.315 mm) and intensity F15A (according to the Almen index) is shown in FIG. 3.

Figure 5:
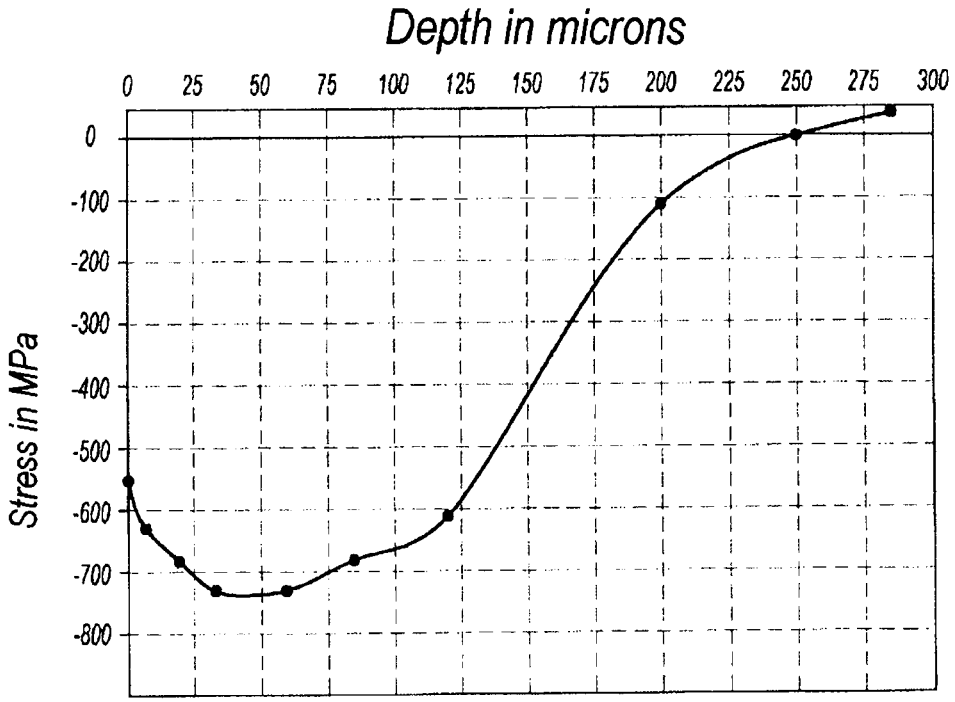
FIG. 5 shows the profile of the stresses obtained by ultrasound shot-blasting, on the analysis area A of FIG. 2.

FIG. 5 shows the profile of the stresses obtained by ultrasound shot-blasting, the subject of the invention, in the area 2 of the hook 20 represented in FIG. 2.

If the results obtained by conventional shot-blasting (FIG. 3) are compared with those obtained by ultrasound shot-blasting (FIG. 5), in the area A of the treated surface, similar stress levels can be observed. However, the ultrasound shot-blasting makes it possible to obtain stresses to a much greater depth (notably in a ratio of 100% relative to conventional shot-blasting).

In the areas A and B of FIG. 2, SEM (scanning electron microscopy) analyses were performed in order to check the coverage obtained by the ultrasound shot-blasting.

The SEM analysis gave a reflected image of the sample (enlarged to 100 000 times or more), revealing details impossible to detect otherwise.

The results of this analysis show a complete coverage in the areas A and B of the hook 20, the absence of residual scratches, and the absence of folds formed by the impacts.

The invention claimed is:

1. A method for ultrasound shot-blasting a metal surface of a turbomachine blade including a foot which is slidably mountable in a dovetailed axial slot of a disk, and a hook which axially retains the turbomachine blade in the dovetailed axial slot of the disk, comprising:

placing a plurality of balls in a chamber to shot-blast a hook of the turbomachine blade; and subjecting a vibrating surface of the chamber to ultrasound oscillations by a sonotrode to create a cloud of balls striking the metal surface including the hook of the turbomachine blade which axially retains the turbomachine blade, the metal surface including a groove provided between the hook and the foot of the blade, and a surface portion outside said groove, wherein the cloud of balls is contained in the chamber encompassing said groove and said surface portion outside said groove, and the chamber is defined by first and second walls on two opposite sides, the vibrating surface on one side, and the surface supporting the hook on another side between the first and second walls, and wherein the cloud of balls in the groove shot-blasts an interior of the groove between the hook and the foot of the blade and shot-blasts the surface portion outside said groove.

2. The shot-blasting method as claimed in claim 1, wherein said groove has a width of between 1.5 mm and 10 mm and a depth of between 1.5 mm and 20 mm.

3. The shot-blasting method as claimed in claim 1 or 2, wherein balls have:

a diameter less than or equal to 2.5 mm, and a weight greater than or equal to 0.5 g.

4. The shot-blasting method as claimed in claim 3, wherein amplitude of ball movements is greater than or equal to 20 μm.

5. The shot-blasting method as claimed in claim 1, wherein shot-blasting treatment time is between 5 and 200 seconds.

6. The shot-blasting method as claimed in claim 1, wherein the balls have a diameter of between 300 μm and 2.5 mm.

7. The shot-blasting method as claimed in claim 1, wherein the balls are steel bearing balls, tungsten carbine balls, or aluminum balls.

8. The shot-blasting method as claimed in claim 1, wherein the hook is made with a material from the group comprising steel, titanium alloys, nickel-based superalloys or aluminums.

9. The shot-blasting method as claimed in claim 1, wherein the groove provided between the hook and the foot of the blade has a width between 1.5 mm and 10 mm, and a depth between 1.5 mm and 20 mm.

10. A method for ultrasound shot-blasting a metal surface of a turbomachine blade including a hook which axially retains the turbomachine blade, comprising:

placing a plurality of balls in a chamber; and subjecting a vibrating surface of the chamber to ultrasound oscillations by a sonotrode to create a cloud of balls striking the metal surface including the hook of the turbomachine blade which axially retains the turbomachine blade, the metal surface including a groove provided between the hook and a foot of the blade, and a surface portion outside said groove, wherein the cloud of balls is contained in the chamber encompassing said groove and said surface portion outside said groove, and the chamber is defined by first and second walls on two opposite sides, the vibrating surface on one side, and the surface supporting the hook on another side between the first and second walls, and wherein the surface supporting the hook on another side between the first and second walls comprises a portion of the foot of the blade in contact with the first chamber wall, and a portion of a platform of the blade in contact with the second chamber wall.

11. A method for ultrasound shot-blasting a metal surface of a turbomachine blade including a hook which axially retains the turbomachine blade, comprising:

placing a plurality of balls in a chamber; and subjecting a vibrating surface of the chamber to ultrasound oscillations by a sonotrode to create a cloud of balls striking the metal surface including the hook of the turbomachine blade which axially retains the turbomachine blade, the metal surface including a groove provided between the hook and a foot of the blade, and a surface portion outside said groove, wherein the cloud of balls is contained in the chamber encompassing said groove and said surface portion outside said groove, and the chamber is defined by first and second walls on two opposite sides, the vibrating surface on one side, and the surface supporting the hook on another side between the first and second walls, and wherein the hook which axially retains the turbomachine blade comprises an axial portion parallel to the blade platform, a radial portion perpendicular to the axial portion, and a rounded transition area between the axial portion and the radial portion, with the blade foot and the radial portion creating the groove between the hook and the foot of the blade.

* * * * *